US006450399B1

(12) United States Patent
Attia et al.

(10) Patent No.: US 6,450,399 B1
(45) Date of Patent: Sep. 17, 2002

(54) PRINTABLE TRIPLE-LAYER MAILER ASSEMBLY

(75) Inventors: Omar S. Attia, Lakeview; Blaine Jackson, East Aurora; Andre Saint, Tonawanda; Brett Ulrich, South Wales, all of NY (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/755,589

(22) Filed: Jan. 5, 2001

(51) Int. Cl.[7] ..... B65D 27/00

(52) U.S. Cl. ..... 229/681; 281/38; 283/116; 462/64

(58) Field of Search ..... 229/301, 69, 68.1; 283/116, 56; 281/38; 462/64

(56) References Cited

U.S. PATENT DOCUMENTS 2,178,084 A * 10/1939 Sawdon ..... 229/68.1 X
2,180,551 A * 11/1939 Sawdon et al. ..... 229/68.1 X
3,419,286 A * 12/1968 Noonan et al. ..... 229/69 X
3,899,381 A * 8/1975 O'Brien et al. ..... 229/69 X
4,384,670 A * 5/1983 Dicker ..... 229/69
4,418,865 A * 12/1983 Bowen ..... 229/69
5,172,855 A * 12/1992 Coffey ..... 229/69 X
5,341,985 A * 8/1994 Peterson ..... 229/69 X
6,149,205 A * 11/2000 Attia et al. ..... 229/68.1 X

* cited by examiner

*Primary Examiner*—Jes F. Pascua
(74) *Attorney, Agent, or Firm*—Oppenheimer Wolff & Donnelly LLP

(57) ABSTRACT

An envelope sheet assembly for stand-alone use, or for securing into a brochure or binder, includes multiple sheets overlying one another so that the assembly is of uniform thickness to facilitate laser, offset, flexograph printing or the like thereon. The envelope sheet assembly is preferably 8½ inches by 11 inches in size, and the envelope is preferably 11 inches by 4½ inches. Permanent pressure sensitive adhesive is employed to hold the sheets together and to form the envelope. The adhesive is also applied to the sealing flap, with a removable strip protecting the adhesive coated flap. The sheet assembly may frame the envelope at all outside edges of the envelope or some of the outer edges of the sheet assembly can form outer edges of the envelope.

29 Claims, 6 Drawing Sheets

FIG. 3
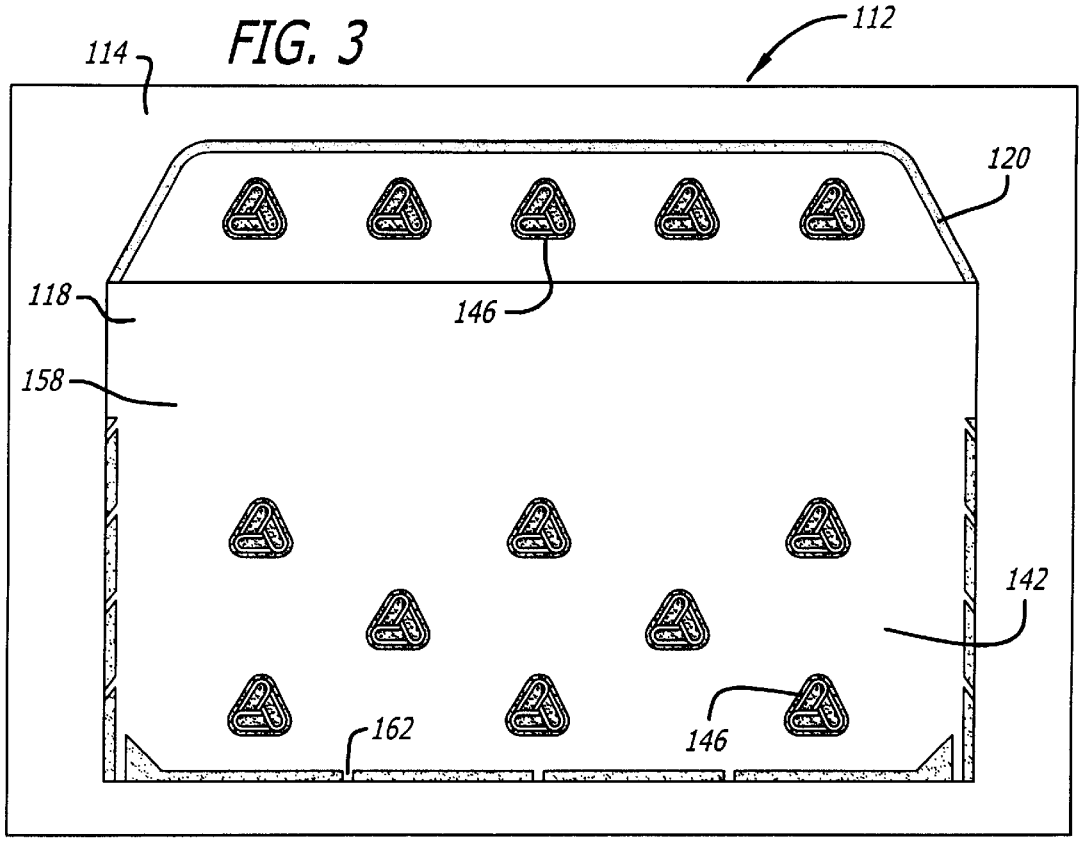
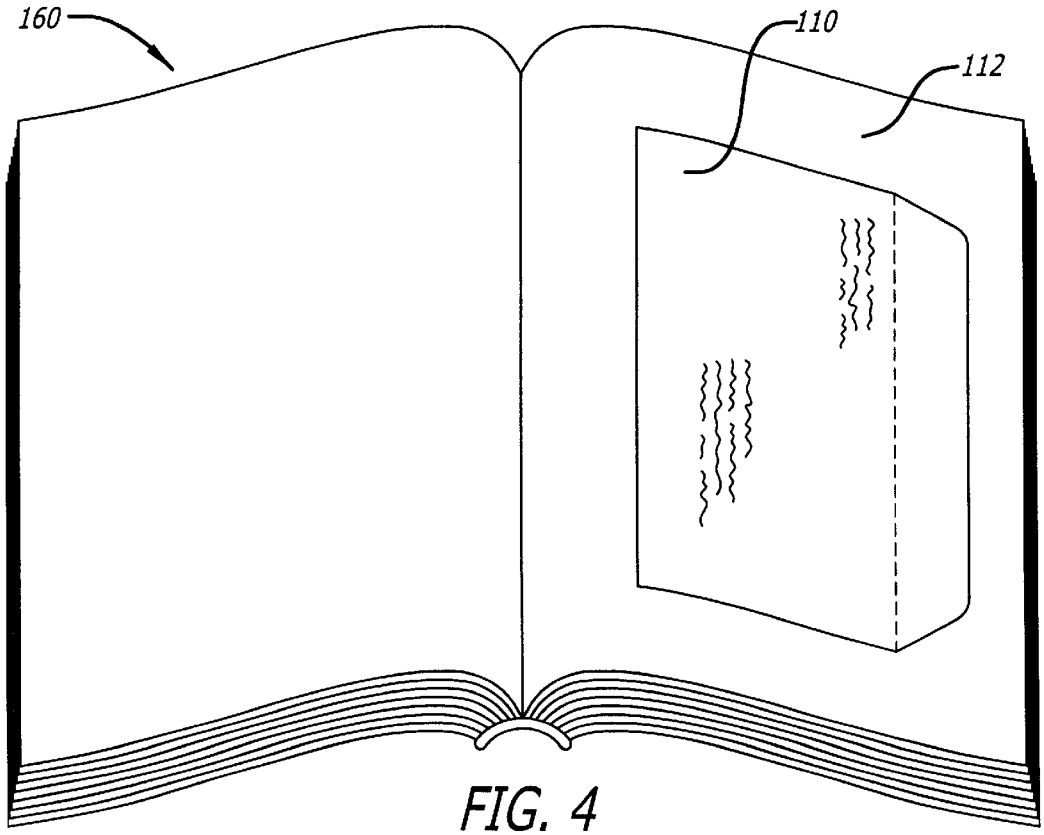
FIG. 4

PRINTABLE TRIPLE-LAYER MAILER ASSEMBLY

FIELD OF THE INVENTION

This invention relates to mailer envelope sheets which may be separate from or included in a brochure, catalog, booklet, binder or the like.

BACKGROUND OF THE INVENTION

It has previously been proposed to include return mailer envelopes in brochures, see R. E. Katz U.S. Pat. No. 4,084,696 granted Apr. 18, 1978. However, the '696 envelope sheet has certain drawbacks. For example, it has an envelope portion which is double thickness, while the remainder of the sheet is a single thickness of paper. For stacking and printing on sheets of paper, it is important that the paper be of uniform thickness to provide regular stacking and to avoid jamming of the copier. In addition, the '696 patent has exposed adhesive which could be activated under high humidity or damp conditions. With exposed activated adhesive, sheets may stick together and laser or ink jet printers may jam or become contaminated.

Prior art return mailer envelope assemblies also fail to adequately protect the envelope during printing, binding and transportation. In prior art assemblies, envelope edges and corners are exposed and can become caught in machinery and bent or torn. Also, the envelope can take on a worn appearance after repeated flipping-through of the article such as a catalog, booklet or brochure into which it is bound.

SUMMARY OF THE INVENTION

Accordingly, it is a principal object of the present invention to provide an envelope sheet assembly which has no exposed adhesive, and which will readily feed through high speed printers without jamming or contamination. It is a further object of the present invention to provide an envelope sheet assembly in which the outside edges and corners of the envelope are protected. The assembly is adapted for inclusion in a brochure, magazine or the like, but may also be used separately from such bound articles.

In one illustrative embodiment of the invention, the envelope sheet assembly is formed of three sheets and is of substantially uniform thickness for high speed printing. The envelope sheet assembly includes top, intermediate and base sheets of paper held together by adhesive. Perforations passing through the top and intermediate sheets form an envelope having a front layer formed from the top sheet and a back layer formed from the intermediate sheet. The back layer has inner and outer surfaces. The top, intermediate and base sheets of paper are of substantially the same size. A die-cut, with optional spaced ties, strikes through the base sheet and intermediate layer, forming a scored envelope sealing flap from the front layer of the envelope and a flap liner strip from the back layer of the envelope (intermediate assembly layer). A release coating is provided on the outer surface of the back layer and is aligned with a pressure sensitive adhesive layer on the surface of the base sheet so that the back layer removably adheres to the base sheet. A coating layer is provided on the inner surface of the back layer along the flap liner strip and is aligned with pressure sensitive adhesive areas on the envelope flap so that the flap liner removably adheres to the envelope flap. An adhesion region free of release material is located on the outer surface of the back layer adjacent to the flap liner for permitting adhesion of the flap to the outer surface of the back layer when sealing the envelope. The adhesion region is preferably substantially free of the silicone release material on the outer surface of the back layer. The adhesive layer on the surface of the base sheet substantially ends at the region of the base sheet aligned with the adhesion region. The envelope is permanently sealed along the bottom and two sides by adhesive on the front layer and inner surface of the back layer. When the envelope is to be closed by the user, the flap liner strip formed in the intermediate layer is stripped off and the adhesive coated flap is folded down onto the adhesion region of the back of the envelope.

The envelope sheet assembly preferably includes an envelope with a length greater than 8½ inches and a width greater than 4 inches for conveniently receiving a standard 8½×11 inches or an A-4 sheet folded three times. It is noted that these dimensions are for standard size 8½ inches by 11 inches, or A-4, sheets included in brochures, and for brochures or the like having different dimensions, the two layer envelope assembly would be correspondingly modified in its dimensions. As noted above, the envelope assembly can also be used stand-alone, without a brochure or the like.

The sheet assembly may also include one or more of the following additional features: (1) an envelope which is approximately 11 inches long; (2) the envelopes may be approximately 4 inches to 5 inches in height; (3) the individual sheets making up the three layer sheet assembly may be formed of fairly lightweight paper so that the sheets may be semi-translucent or semi-transparent; and (4) the inside surfaces of the envelope may be provided with a printed pattern to preclude reading enclosures through the envelope.

Other objects, features and advantages of the invention will become apparent from a consideration of the following detailed description and from the accompanying drawings.

BRIEF DESCRIPTION OF THE DRAWINGS

FIG. 3 shows the remainder of the assembly after the envelope has been removed.

FIG. 4 shows a brochure which includes the printable triple-layer mailer assembly of FIG. 1.

DETAILED DESCRIPTION OF PREFERRED EMBODIMENTS

Figure 1:
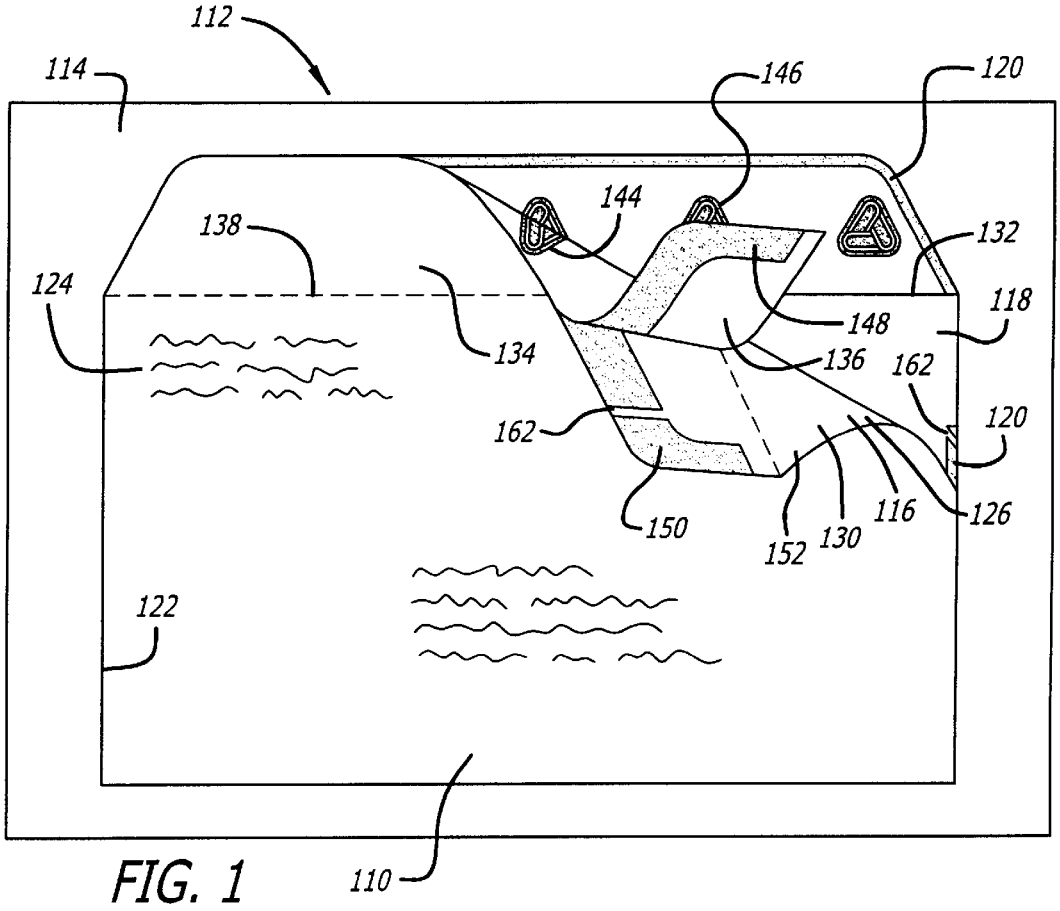
FIG. 1 shows a printable triple-layer mailer assembly of the present invention with the envelope partially removed from the assembly and the flap liner strip partially peeled off from the flap.

FIG. 1 shows an envelope 110 partially removed from the envelope assembly 112. A flap liner strip 136 is shown partially peeled off from a sealing flap 134. The envelope sheet assembly includes top 114, intermediate 116 and base 118 sheets of paper held together by adhesive 120 (also see FIG. 5). The top 114, intermediate 116 and base 118 sheets may have the same predetermined standard size, such as 8 ½×11 inches, A-4 or legal size paper.

Figure 7:
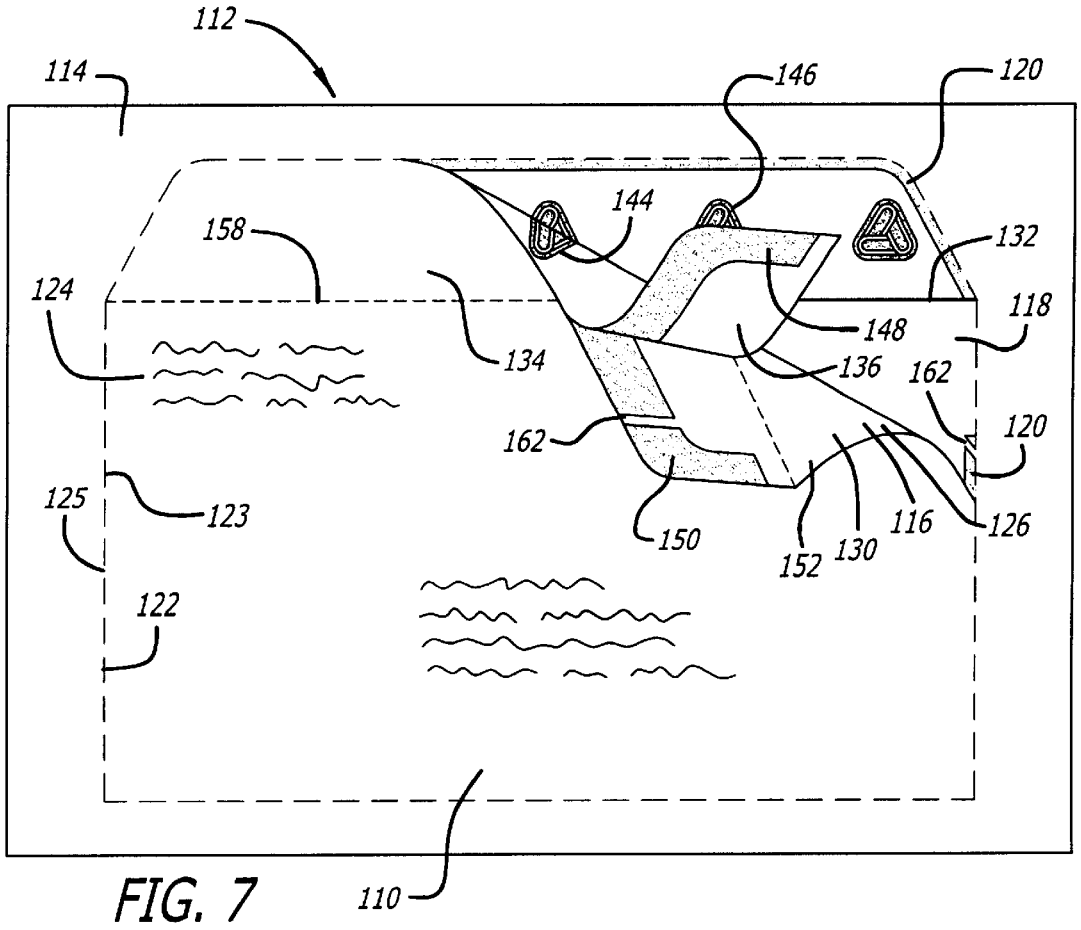
FIG. 7 shows an embodiment of the printable triple-layer mailer assembly of FIG. 1 with the perforations having a few widely spaced cuts and ties.

Die-cuts or perforations 122 passing through the top 114 and intermediate 116 sheets form the envelope 110 having a front layer 124 formed from the top sheet 114 and a back layer 126 formed from the intermediate sheet 116. The perforations 122 ran be fully or cleanly die cut (see FIG. 1) or alternatively can have a few widely spaced cuts 123 and ties 125 (see FIG. 7). The perforations 122 passing through the top sheet 114 form the front layer 124 of the envelope including the sealing flap 134. The back layer of the envelope 126 has inner 128 (see FIG. 5) and outer 130 surfaces. The sealing flap 134 may have a score line 138. The sealing flap 134 is folded along the score line 138 when folding the sealing flap 134 to the back layer 126. The perforations 122 passing through the intermediate sheet 116 can be fully cut to form the back layer 126 of the envelope 110 and the separate flap liner 136 for covering the sealing flap 134 of the envelope 110. The perforations 122 passing through the intermediate sheet 116 can alternatively consist of a cut and tie pattern die cut to form the back layer 126 of the envelope 110 and the separate flap liner 136 for covering the sealing flap 134 of the envelope 110. Die-cut perforations 132 strike through the base sheet 118 and back layer 116 to form the score line 138 at the bottom of the sealing flap 134 and to form the flap liner 136 from the back layer 126 of the envelope 110.

A releasable layer 140 (see FIG. 2) is formed on the outer surface 130 of the back layer 126 and is aligned with a pressure sensitive adhesive layer 142 (see FIG. 3) on the surface of the base sheet 118 so that the back layer 126 removably adheres to the base sheet 118. The releasable layer 140 can include of a plurality of silicone segments 144. The pressure adhesive layer 142 can include of a plurality of adhesive segments 146 as well as areas of the adhesive 120 on the base sheet 118 proximate the edges of the envelope. Each of the silicone segments 144 positioned on the back layer is positioned to overlap one of the corresponding adhesive segments 146 positioned on the base sheet 118. With some types of adhesive and paper, the silicone on the releasable layer 140 is unnecessary because even without the silicone, the envelope is securely held to the base sheet 118, yet is easily peeled away from the adhesive layer 142.

The sealing flap 134 has an adhesive layer 150 for adhering to the back layer 126 when the flap 134 is folded down along the score line 138, thereby sealing the top of the envelope 110. The flap liner 136 covers the sealing flap 134 of the envelope 110. A silicone release layer 148, is formed on the inner surface of the back layer 126 along the flap liner 136 and is aligned with the pressure sensitive adhesive layer 150 on the envelope flap 134 so that the flap liner 136 removably adheres to the envelope flap 134. An adhesion region 152 is formed on the outer surface 130 of the back layer 126 adjacent to the flap liner 136 for permitting adhesion of the adhesive layer 150 of the flap 134 to the outer surface of the back layer when sealing the envelope 110 (see also FIG. 2). The adhesion region 152 forms a gap in the releasable layer 140 in the region below the flap liner 136. The adhesion region 152 need not be entirely free of the silicone segments 144 forming release layer 140, but must at least present enough release-layer-free surface so that the adhesive layer 150 can securely adhere to the outer surface 130 of the back layer 126.

The adhesive force between the sealing flap 134 and the flap liner 136 should be greater than the adhesive force between the base sheet 118 and the flap liner 136 so that when the envelope 110 is peeled away from the envelope assembly 112, the flap liner 136 remains adhering to the sealing flap 134. Also, the adhesive layer 142 should hold the envelope securely to the envelope assembly so that the envelope will not become disengaged when being fed though various printing devices when printing on the front layer 124 of the envelope 110. The envelope 110 is also held securely enough so that it will not become accidentally disengaged from the envelope assembly 112 when handling a brochure or binder into which the envelope assembly 112 has been bound. On the other hand, the adhesive layer 142 allows for easy manual removal of the envelope 110 from the envelope assembly 112 without damage to the envelope 110 by peeling the envelope 112 from the base sheet 118.

Figure 2:
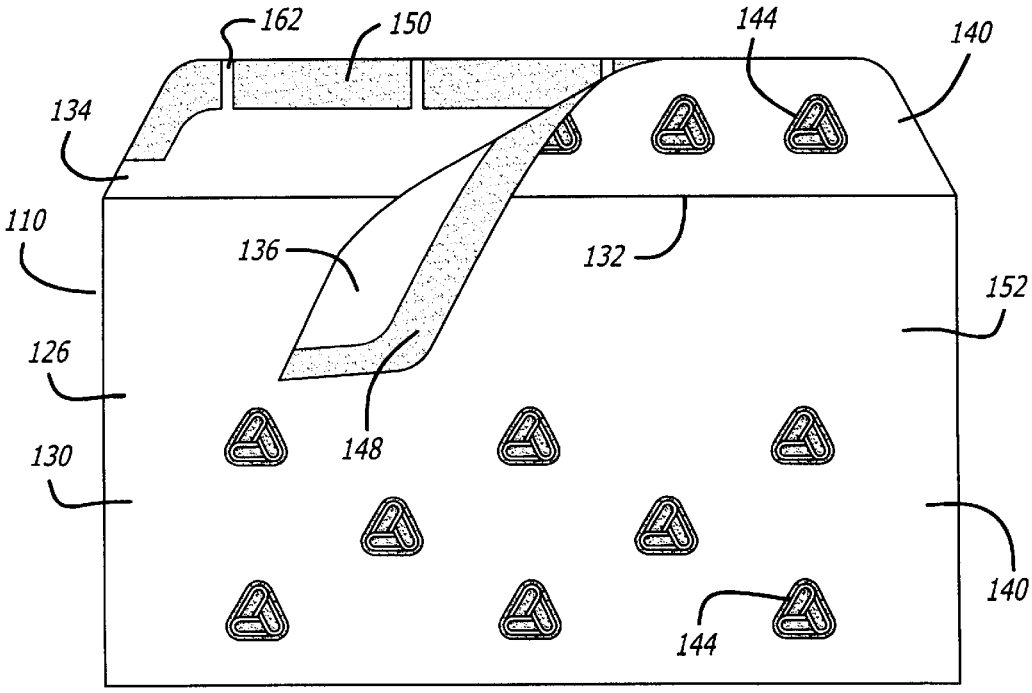
FIG. 2 shows the back side of the envelope with the flap liner strip partially peeled off from the flap.

FIG. 2 more clearly shows the back of the envelope 110. The envelope 110 has been peeled off from the remainder of the envelope assembly 112. The flap liner strip 136 is shown partially peeled off from the flap 134. Also shown are the silicone segments 144 forming the releasable layer 140. The adhesion region 152 without the silicone segments 144 is shown as well.

FIG. 3 shows the remainder of the envelope assembly 112 after the envelope 110 has been peeled away as shown in FIG. 2. The adhesive layer 142 is shown formed of areas of the adhesive 120 as well as the adhesive segments 146. The base sheet 118 has a substantially adhesive-free region 158. The adhesive-free region 158 is aligned with the adhesion region 152, so that the adhesive layer 142 will not stick to the unprotected adhesion region 152. In some embodiments, when special adhesive or paper is used, it is unnecessary to use the adhesive-free region 158 because the envelope can be peeled from the adhesive layer 142 even with the adhesive layer 142 adhering to the adhesion layer 152.

FIG. 4 shows the envelope assembly 112 bound in an article 160. The envelope 110 is framed and held firmly by the assembly 112 so that the envelope will not become accidentally disengaged when binding or during mailing or use of brochure 160. The assembly 112 also protects the envelope outside corners and edges from tearing or fraying during binding, mailing or use. The article 160 can be a book, magazine, catalog, mailer or other articles into which the envelope assembly 112 can be bound. Additionally, the envelope assembly 112 and be used in a stand alone configuration without the article 160.

Figure 5:
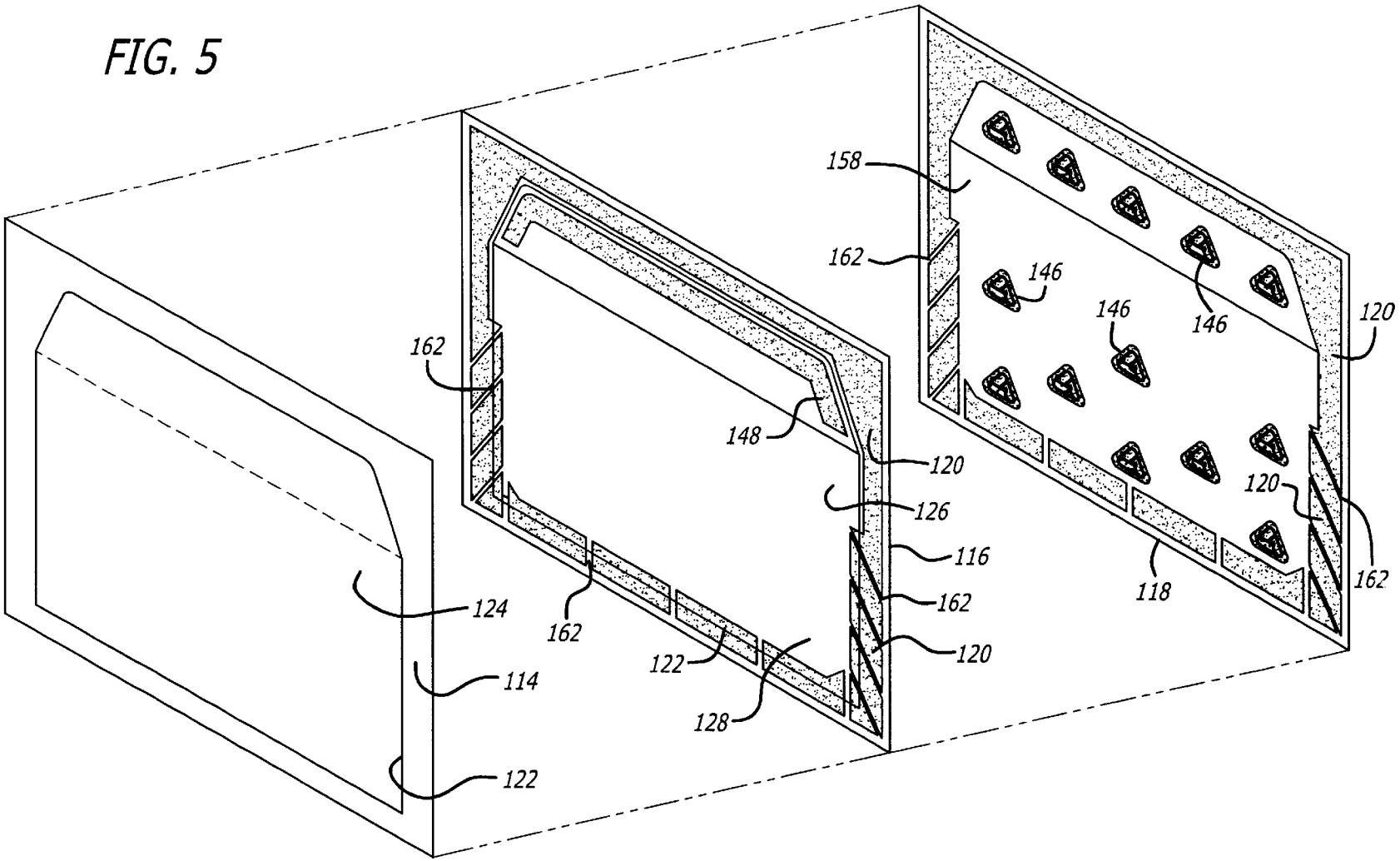
FIG. 5 shows an exploded view of an embodiment of the triple-layer mailer assembly.

FIG. 5 shows an exploded view of the envelope assembly 112. The envelope assembly 112 is made from the top sheet 114, the intermediate sheet 116 and the base sheet 118. The sheets are held together by the adhesive 120. The outer edges of the sheets are coated with pressure sensitive adhesive. The adhesive 120 extends from the outer edges of each sheet and across the perforations 122 to the area within the front layer 124 and back layer 126. In this way, the envelope 110 is sealed on three sides and the envelope assembly 112 is secured on four sides. Vents or gaps 162 in the adhesive 120, 150 allow air to pass between the inside and outside of envelope 42. The gaps can be wider than 1/32 inch, for example. The inner surface of the top sheet 114 (not shown) may also have adhesive 120 with vents 162 having the same spatial arrangement as the adhesive 120 and vents 162 illustrated coating the edges of the intermediate sheet 116. Thus, the adhesive 120 and vents 162 on the top sheet 114 and intermediate sheet 116 match each other to secure the two sheets together.

Figure 6:
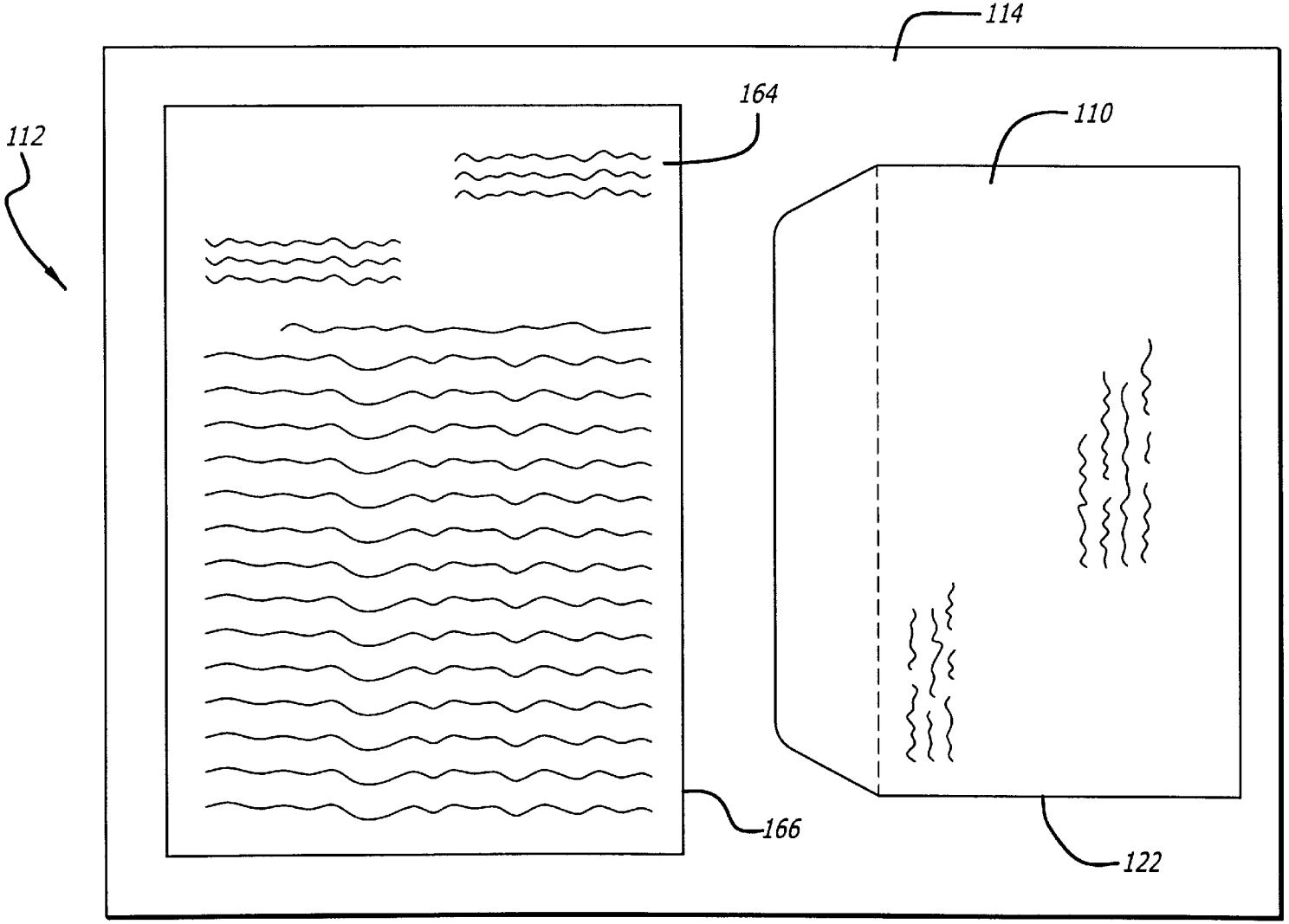
FIG. 6 shows an embodiment of the triple-layer mailer assembly of the present invention including a mailer along with the envelope.

FIG. 6 shows an embodiment of the triple-layer mailer assembly of the present invention including a mailer 164 along with the envelope 110. The mailer 164 can be a letter, a contract or an order form, for example. As in the embodiment of FIG. 1, the envelope 110 is formed by the perforations 122. In the present embodiment, the mailer 164 is also formed in the top sheet 114 by perforations 166. The mailer 164 can be one or more pages and is held within the assembly 112 by adhesive. When the mailer 164 has multiple pages, one page can be formed from the top sheet 114, a second page from the intermediate sheet 116 and a third page from the base sheet.

Figure 8:
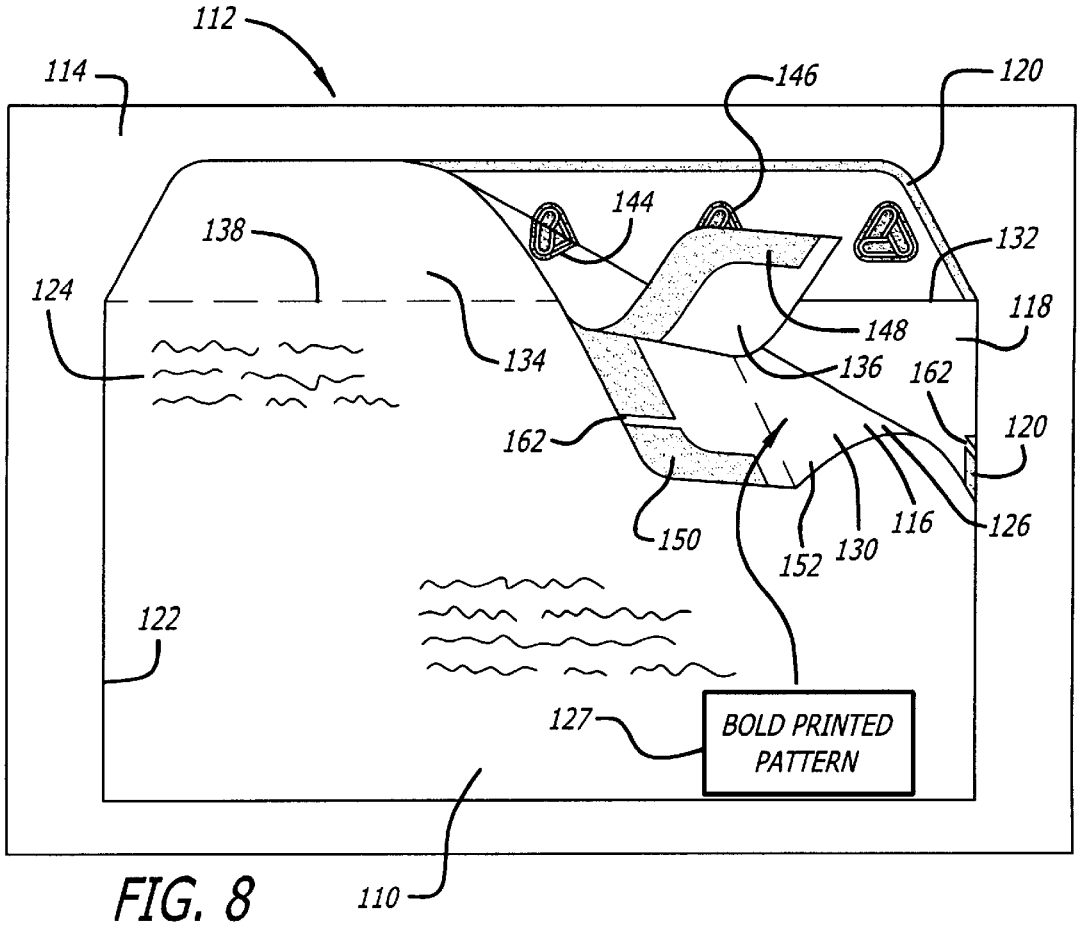
FIG. 8 shows an embodiment of the printable triple-layer mailer assembly of FIG. 1 having a bold printed pattern on the inside surfaces of the envelope to preclude reading enclosures through the envelope.

Inside the envelope front 124 and back 126 layers, on the front layer inner surface and the back layer inner surface 128, can be bold printed patterns 127 as illustrated schematically in FIG. 8. For easy printing using xerographic or ink jet printers, it is desirable that the envelope assembly 112 be relatively thin and flexible. As a result, the paper forming the front and back of the envelope may be semi-translucent or semi-transparent, so the bold printed pattern 127 is useful to preclude reading of material enclosed within the envelope. By way of example, 20 pound paper may be used for each sheet of the two sheet assembly. When the term "20 pound paper" is used, it means that 500 sheets of paper 17 inches by 22 inches in size, weighs 20 pounds. Incidentally, while any pressure sensitive adhesive may be used, rubber based, hot melt permanent pressure sensitive adhesive is preferred.

Concerning dimensions, each of the sheets of the envelope assembly 112 may be 8½×11 inches, or A-4 size paper. The bottom and two sides of the envelope 110 are bonded together by permanent adhesive, which may be the same pressure sensitive adhesive used on the sealing flap of the envelope. The envelopes are preferably 11 inches in length and between 4 and 5 inches, preferably about 4½ inches, in height. Thus, a height of at least 4 inches and a length of at least 9 inches for the envelopes is desired.

In conclusion, it is to be understood that the foregoing detailed description and accompanying drawings are illustrative of the principles of the invention. Various changes and modifications may be employed, for example, different sizes of paper such as 8½×14 inches, or other sizes and weights of paper may be employed, with envelope size being accordingly modified. Additionally, more than three sheets can be used in forming the envelope assembly. For example, four sheets of paper can be secured together to form a three layer envelope sheet assembly. Accordingly, the invention is not limited to the specific embodiments described and shown in the drawings.

What is claimed is:

1. A multi-layer envelope sheet assembly comprising:

top, intermediate and base sheets of paper of substantially the same size and held together by adhesive;

cuts passing through the top and intermediate sheets so that the sheets have clean-cut edges and forming an envelope having a front layer formed from the top sheet and a back layer formed from the intermediate sheet, the back layer having inner and outer surfaces;

an envelope flap formed from the front layer of the envelope and a flap liner formed from the back layer of the envelope, the flap liner removably secured by adhesive to the envelope flap;

adhesive removably securing the back layer of the envelope to the base sheet;

and wherein the envelope is sealed along the bottom and two sides by adhesive between the front layer and inner surface of the back layer.

2. The multi-layer envelope sheet assembly of claim 1, wherein:

said base sheet and said intermediate sheet are cut to form the flap liner from the intermediate sheet and to form a score line on the top sheet at the base of the envelope flap.

3. The multi-layer envelope sheet assembly of claim 1, wherein: the cuts are die-cut.

4. The multi-layer envelope sheet assembly of claim 1, wherein:

the adhesive holding the sheets together extends from the outer edges of each sheet and across the cuts to within the front layer and back layer.

5. The multi-layer envelope sheet assembly of claim 4, wherein:

the adhesive holding the sheets together has gaps allowing air to pass between the inside and outside of envelope.

6. The multi-layer envelope sheet assembly of claim 1, wherein:

the envelope sheet assembly is secured in a brochure, magazine or binder at an outer edge of the envelope sheet assembly.

7. The multi-layer envelope sheet assembly of claim 1, wherein:

the envelope has a length greater than 8½ inches and a width greater than 4 inches for conveniently receiving a sheet 8½ inches by 11 inches, or a A-4 sheet folded three times.

8. An envelope sheet assembly as defined in claim 1 wherein said envelope is approximately 11 inches long, and is between 4 and 5 inches in height.

9. An envelope sheet assembly as defined in claim 1 wherein each of the sheets making up said assembly is of lightweight semi-transparent paper, and wherein the inner surfaces of said envelope have a bold printed pattern to preclude reading material contained in said envelope.

10. An assembly as defined in claim 1 further comprising a brochure, magazine or binder into which the envelope sheet assembly is mounted, said brochure, magazine or binder having additional pages having substantially the same size as said envelope sheet assembly.

11. An envelope sheet assembly as defined in claim 1 wherein said envelope sheet assembly has dimensions of substantially 8½ inches by 11 inches, or A-4 paper.

12. An envelope sheet assembly as defined in claim 1 further comprising an address printed on said envelope.

13. An envelope sheet assembly as defined in claim 1 wherein said envelope is sealed along the bottom and two sides thereof with permanent pressure sensitive adhesive.

14. The multi-layer envelope sheet assembly of claim 1, wherein:

the sheets are of substantially uniform thickness for high speed printing on the envelope sheet assembly.

15. The multi-layer envelope sheet assembly of claim 1, wherein:

the envelope has dimensions substantially less than the dimensions of the envelope sheet assembly.

16. A printer feedable envelope assembly comprising:

a base sheet having a predetermined standard size;

an intermediate sheet having substantially the same predetermined size and die cut to form the back of an envelope and the separate liner for a sealing flap of the envelope;

a top sheet having the same predetermined size but being die cut to form the front and sealing flap of the envelope;

pressure sensitive adhesive on said base sheet to hold said intermediate sheet removably onto said base sheet, with said intermediate sheet having release material thereon to facilitate separation of said base and intermediate sheets;

adhesive holding said front and back of said envelope together and for holding said flap down onto the back of said envelope;

a release layer on the side of said liner facing said envelope flap.

17. The assembly of claim 16, farther comprising:

a bound brochure containing the assembly as one page thereof.

18. The assembly of claim 16, wherein:

the adhesive on said base sheet is releasable pressure sensitive adhesive.

19. The assembly of claim 16, wherein:

the adhesive between said intermediate and top layers is permanent pressure sensitive adhesive.

20. A multi-layer envelope sheet assembly comprising:

top, intermediate and base sheets of paper of substantially the same size and held together by adhesive;

cuts passing through the top and intermediate sheets forming an envelope having a front layer formed from the top sheet and a back layer formed from the intermediate sheet, the back layer having inner and outer surfaces;

an envelope flap formed from the front layer of the envelope and a flap liner formed from the back layer of the envelope, the flap liner removably secured by adhesive to the envelope flap;

adhesive located on the base sheet removably securing the back layer of the envelope to the base sheet;

release material provided on the outer surface of the back layer and aligned with the adhesive on the base sheet;

and wherein the envelope is sealed along the bottom and two sides by adhesive between the front layer and inner surface of the back layer.

21. The multi-layer envelope sheet assembly of claim 20, wherein:

the release material is made of silicone.

22. The multi-layer envelope sheet assembly of claim 20, further comprising:

an adhesion region formed on the outer surface of the back layer adjacent to the flap liner for permitting adhesion of the flap to the outer surface of the back layer when sealing the envelope and wherein the release layer formed on the outer surface of the back layer substantially ends at the adhesion region.

23. The multi-layer envelope sheet assembly of claim 22, wherein:

the adhesive layer on the surface of the base sheet substantially ends at the region of the base sheet aligned with the adhesion region.

24. A multi-layer envelope sheet assembly comprising:

top, intermediate and base sheets of paper of substantially the same size and held together by adhesive;

cuts passing through the top and intermediate sheets forming an envelope having a front layer formed from the top sheet and a back layer formed from the intermediate sheet, the back layer being free of addressee information;

an envelope flap formed from the front layer of the envelope and a flap liner formed from the back layer of the envelope, the flap liner removably secured by adhesive to the envelope flap;

adhesive removably securing the back layer of the envelope to the base sheet;

and wherein the envelope is sealed along the bottom and two sides by adhesive.

25. The multi-layer envelope sheet assembly of claim 24, wherein:

the cuts form a cut and tie pattern and the ties attach the envelope to the envelope sheet assembly.

26. A multi-layer envelope sheet assembly comprising:

top, intermediate and base sheets of paper of substantially the same size and held together by adhesive;

cuts passing through the top and intermediate sheets forming an envelope having a front layer formed from the top sheet and a back layer formed from the intermediate sheet, the back layer having inner and outer surfaces;

an envelope flap formed from the front layer of the envelope and a flap liner formed from the back layer of the envelope, the flap liner removably secured by adhesive to the envelope flap;

adhesive formed on the envelope flap removably securing the back layer of the envelope to the base sheet;

a release layer formed on the flap liner and aligned with the adhesive formed on the envelope flap;

and wherein the envelope is sealed along the bottom and two sides by adhesive between the front layer and inner surface of the back layer.

27. A multi-layer envelope sheet assembly comprising:

top, intermediate and base sheets of paper of substantially the same size and held together by adhesive;

cuts passing through the top and intermediate sheets forming an envelope having a front layer formed from the top sheet and a back layer formed from the intermediate sheet, the back layer having inner and outer surfaces;

the envelope having outside corners and edges formed by the cuts passing through the top and intermediate sheets forming the envelope so that the envelope is framed by the envelope sheet assembly at the outside corners and edges of the envelope;

an envelope flap formed from the front layer of the envelope and a flap liner formed from the back layer of the envelope, the flap liner removably secured by adhesive to the envelope flap;

adhesive removably securing the back layer of the envelope to the base sheet;

and wherein the envelope is sealed along the bottom and two sides by adhesive between the front layer and inner surface of the back layer.

28. A multi-layer envelope sheet assembly comprising:

top, intermediate and base sheets of paper of substantially the same size and held together by adhesive;

cuts passing through the top and intermediate sheets forming an envelope having a front layer formed from the top sheet and a back layer formed from the intermediate sheet, the back layer having inner and outer surfaces;

an envelope flap formed from the front layer of the envelope and a flap liner formed from the back layer of the envelope, the flap liner removably secured by adhesive to the envelope flap;

adhesive removably securing the back layer of the envelope to the base sheet;

and wherein the envelope is sealed along the bottom and two sides by adhesive between the front layer and inner surface of the back layer;

and wherein the envelope assembly is die-cut through the base sheet towards the top sheet, resulting in a line of perforations forming the base of the flap liner and a score line at the base of the envelope flap.

29. A multi-layer envelope sheet assembly comprising:

top, intermediate and base sheets of paper of substantially the same size and held together by adhesive;

a mailer formed in the top sheet;

cuts passing through the top and intermediate sheets forming an envelope having a front layer formed from the top sheer and a back layer formed from the intermediate sheet, the back layer having inner and outer surfaces;

an envelope flap formed from the front layer of the envelope and a flap liner formed from the back layer of the envelope, the flap liner removably secured by adhesive to the envelope flap;

adhesive removably securing the back layer of the envelope to the base sheet;

and wherein the envelope is sealed along the bottom and two sides by adhesive between the front layer and inner surface of the back layer.

* * * * *